US005113557A

United States Patent [19]

Maitra et al.

[11] Patent Number: 5,113,557

[45] Date of Patent: May 19, 1992

[54] APPARATUS FOR PRODUCING GALVANIZED TUBING

[75] Inventors: Kalyan K. Maitra, Matteson; Vijay B. Patel, Orland Park, both of Ill.

[73] Assignee: Allied Tube & Conduit Corporation, Harvey, Ill.

[21] Appl. No.: 672,097

[22] Filed: Mar. 19, 1991

Related U.S. Application Data

[62] Division of Ser. No. 438,780, Nov. 17, 1989, Pat. No. 5,035,042.

[51] Int. Cl.[5] ..... B23P 11/00; B21K 31/06

[52] U.S. Cl. ..... 29/33 D; 228/147

[58] Field of Search ..... 29/33 D, 33 T, 527.4, 29/460, 430, 33 K, 458; 228/147; 219/118; 427/349, 331; 204/28; 118/76

[56] References Cited

U.S. PATENT DOCUMENTS

| | | | |
|---|---|---|---|
| 3,122,114 | 2/1964 | Kringel et al. | 29/564 |
| 3,733,670 | 5/1973 | Troughton | 29/460 X |
| 3,768,145 | 10/1973 | Ostrowski | 29/460 X |
| 3,827,139 | 8/1974 | Norteman | 29/527.4 X |
| 3,845,540 | 11/1974 | Rossi et al. | 29/430 |
| 3,927,816 | 12/1975 | Kakamura | 228/147 |
| 4,082,212 | 4/1978 | Headrick et al. | 29/527.4 |

*Primary Examiner*—William Briggs

*Attorney, Agent, or Firm*—Fitch, Even, Tabin & Flannery

[57] ABSTRACT

An improved method of manufacturing galvanized steel tubing from steel strip having at least one galvanized surface, which surface becomes the exterior surface of the tubing is provided. In the method of the invention, after the steel strip is roll-formed and welded to complete the tubing and the welded seam is scarfed to remove irregularities, a quantity of an acid solution is applied to substantially only the scarfed area to react with oxidized metal, and the rinsed, leaving the non-scarfed galvanized exterior surface intact. The tubing is then heated to a temperature sufficient to cause the galvanized coating of the exterior surface to begin to flow and the tubing is regalvanized to produce an improved galvanized exterior surface, which is resistant to cracking along the scarfed area. Also provided is an apparatus for applying a pickling acid solution to substantially only the scarfed area of continuously formed tubing, which apparatus may be used to modify conventional continuous roll-forming mill tubing production lines to perform the method of the invention.

5 Claims, 2 Drawing Sheets

APPARATUS FOR PRODUCING GALVANIZED TUBING

This is a division of application Ser. No. 07/438,780, filed Nov. 17, 1989 U.S. Pat. No. 5,035,042.

The present invention relates to continuous forming of galvanized tubing and, more particularly, to forming galvanized tubing from galvanized steel strip, such that the resulting tubing has a uniform and integral exterior zinc coating. The present invention also relates to an improved tube mill production line for performing the method of the invention.

BACKGROUND OF THE INVENTION

It is well know to produce endless lengths of welded steel tubing from strip stock into continuously galvanized tubing by providing a zinc coating on the exterior surface as taught, for example, in U.S. Pat. Nos. 3,122,114, 3,230,615 and 3,561,096, which are owned by the assignee of this patent application.

It is also desirable to form continuous galvanized tubing from galvanized strip stock to provide tubing which is galvanized on both the interior and exterior surfaces in order to increase longevity of the tubing. In a method for producing such galvanized tubing, a metallizing gun, known in the art for spraying melted, finely particulated zinc (e.g. to galvanize threaded sections of a workpiece) is used to complete the galvanization of the exterior surface, after the seam of the tubing is scarfed to remove the bead resulting from welding.

A problem with galvanized tubing produced by prior art methods in which zinc coating is sprayed onto the seam area with a metallizing gun is that the zinc coating of the seam is susceptible to flaking and cracking from stress when the tubing is bent by workers at the site of installation, presumably because the sprayed-on zinc coating does not form any intermetallic compound with the steel substrate at the scarfed area. Consequently, premature corrosion of the tubing at points where the sprayed-on zinc coating has cracked or flaked off is a serious disadvantage of such tubing. It would therefore be very desirable to provide an improved method of manufacturing continuous lengths of tubing having both a galvanized interior surface and a continuous, integral, galvanized exterior surface, which tubing may be bent without exhibiting the above-discussed problem.

SUMMARY OF THE INVENTION

Among the various aspects and features of the present invention may be noted the provision of an improved method of manufacturing galvanized steel tubing from galvanized strip. In accordance with the method of the present invention, after galvanized strip is roll-formed, welded and scarfed, the tubing is acid-treated substantially only along the scarfed area, rinsed to remove reaction products which inhibit galvanization, and heated to a temperature sufficient to cause the zinc coating on the unscarfed exterior surface to begin to flow. The heated tubing is then contacted with molten zinc to form a circumferentially continuous layer of molten zinc around the exterior surface of the tubing, including the scarfed area, which upon cooling forms an integral galvanized surface. In other words, the method of the invention comprises regalvanizing the pregalvanized exterior surface of tubing, even though only the scarfed area exposes raw steel. This ensures uniform bonding between the zinc coating on the scarfed area and that of the adjacent pregalvanized area and consequently the tubing produced by the method of the invention is exceptionally resistant to cracking and/or flaking of the exterior surface.

After scarfing and before regalvanizing, the oxides formed on the raw steel at the seam must be removed. A very important aspect of the method of the invention concerns pickling substantially only the welded seam area to remove the oxides, while preventing acid from contacting the remainder of the exterior (galvanized) surface, to greatly limit the amount of by-product produced. The acid-treatment of substantially only the scarfed area of the continuously advancing tubing is carried out by contacting said area with an acid-saturated wick as the tubing advances through the production mill. The position of the wick relative to the scarfed area may be laterally adjusted to compensate for drift of the tubing during production runs.

The method of the present invention can be practiced with only slight modification to existing production lines for manufacturing galvanized steel tubing. Other aspects and features of the invention will be described below.

Briefly, the method of the present invention includes the following steps:

1. A galvanized metal strip is formed into tubing having a galvanized exterior surface as the strip moves along a straight line longitudinal path.
2. Adjacent lateral edges of the moving strip are continuously welded to complete the tubing.
3. Irregularities formed along the welded seam formed are removed using a scarfing tool.
4. The tube is cleaned to remove any lubricant associated with roll-forming.
5. A quantity of acid is applied to substantially only the scarfed seam area to react with oxidized metal resulting from the scarfing step.
6. The tube is rinsed to remove the reaction products, as well as any unreacted acid, and dried.
7. The tubing is heated in an inert atmosphere to a temperature sufficient to cause the zinc layer on the exterior surface of the tubing to become flowable.
8. The heated, zinc-coated, exterior surface of the tubing is contacted with additional molten zinc, so as to form a uniform layer of molten zinc around the circumference of the exterior surface including scarfed area.
9. The tubing is cooled to complete the regalvanizing step.

An apparatus for modifying a conventional continuous roll-forming tube production mill to practice this method is also disclosed.

DETAILED DESCRIPTION OF THE INVENTION

Figure 1:
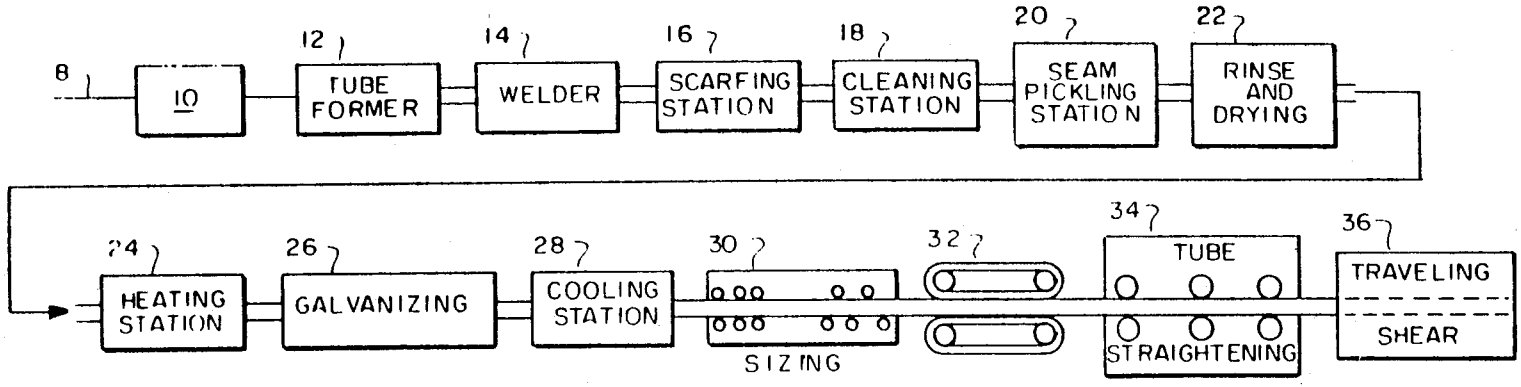
FIG. 1 is a diagrammatic illustration, in block form, of an in-line, continuous, roll-forming tube mill production line, including a seam-pickling station and a galvanizing station, embodying various aspects of the method of the present invention.

Referring now to the drawings, a preferred embodiment of an in-line, continuous, roll-forming tube mill production line is illustrated in diagrammatic form in FIG. 1. Each of the stations is considered to be treating galvanized steel strip moving from left to right. At the upper left-hand corner, strip 8 is shown which may be supplied from a suitable roll source (not shown). The method of the present invention requires metal strip which is galvanized on at least one side; however, if the strip is galvanized on only one side, the galvanized side must form the exterior surface of the tubing. Typically, the strip is galvanized on both the surface which forms the interior surface of the tube and the surface which forms the exterior surface of the tube. The strip travels past an end welder (not shown), known in the art for splicing the trailing and of one roll of strip steel to the leading end of another roll of strip steel (whenever necessary), and enters an accumulator 10 wherein a sufficient length of strip is stored to supply the production line while the just-noted end-to-end weld is made. Likewise, the edges of the strip may be appropriately treated so as to be ready for welding at the time that the strip 8 enters a tube former 12. The tube former is constituted by a series of conventional forming rolls whereby the strip is continuously deformed from its initial flat character to that of a rounded tube with the lateral edges of the strip in approximately abutting relation to form the seam of the tube upon welding.

Figure 3A:
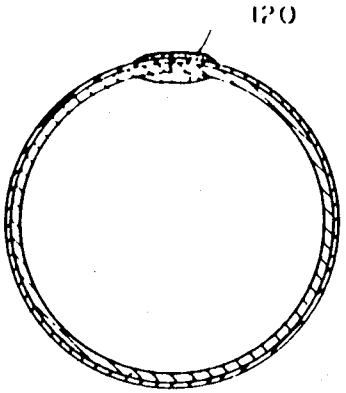
FIGS. 3A-3D are cross-sectional views of the tubing after welding (FIG. 3A), after scarfing (FIG. 3B), during application of acid at the seam pickling station (FIG. 3C), and after regalvanization (FIG. 3D).
Figure 3B:
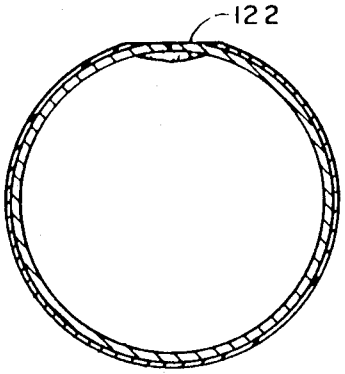

The continuous tubular form created by the tube former 12 advances directly to a welder 14 where the edges of the strip are joined by welding, preferably using an induction welder. After the welding is complete the tubing is passed to a scarfing station 16 where the outer surface of the welded region is shaved to remove irregularities of the welded seam 120 so as to leave a smooth scarfed area 122 on the outer periphery of the tubing. FIGS. 3A and 3B, respectively, show a cross-section of tubing after welding, and after scarfing is completed.

After the scarfing step, the tube may be passed to a cleaning station 18 to remove lubricant used in the roll-forming process. It is preferred to use water-soluble lubricants so that hot water may be used as a cleaning solution. An alkali wash followed by a water rinse may be used to remove certain, less water-soluble, lubricants.

Figure 4:
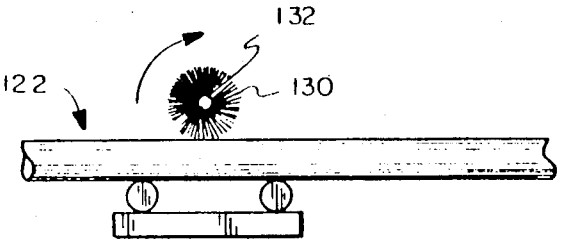
FIG. 4 is a perspective view of a circular wire brush which may optionally be used to mechanically remove metal oxides from the scarfed area of the tubing before regalvanizing.
Figure 5:
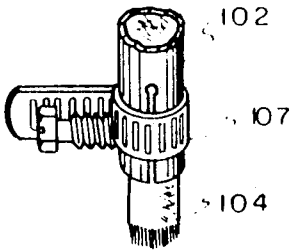
FIG. 5 is a perspective view of a clamp for regulating the flow of acid to a wick.

As those skilled in the art will recognize, the steel surface exposed due to seam scarfing is highly prone to oxide formation because of high heat and base metals reactivity with air. Optionally, after scarfing and before seam pickling, amounts of metal oxide may be mechanically removed. FIG. 4 depicts an apparatus for removing metal oxide employing a rotating, circular wire brush 130 (e.g. 4" o.d., 1" width), which is mounted on a shaft 132 of a motor which rotates the brush in a direction opposite to the direction of the advancing tube. Such mechanical removal of metal oxide may be beneficial before seam pickling where a large amount of metal oxide is present on the scarfed area.

Figure 3C:
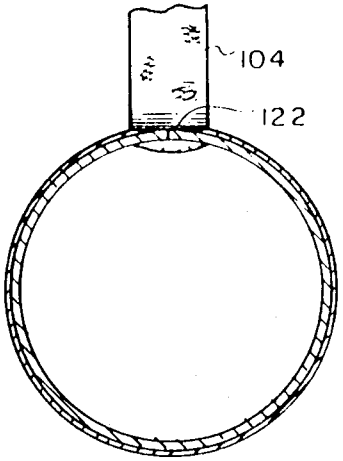

In any event, after the cleaning station, the scarfed tubing is advanced to a seam pickling station 20 for acid-treatment of substantially only the scarfed area 122. (See FIG. 3C). In light of the high temperatures associated with tube mill production lines, it is very important that acid treatment be confined to the scarfed area to minimize the potential for evolving explosive hydrogen gas.

Figure 3D:
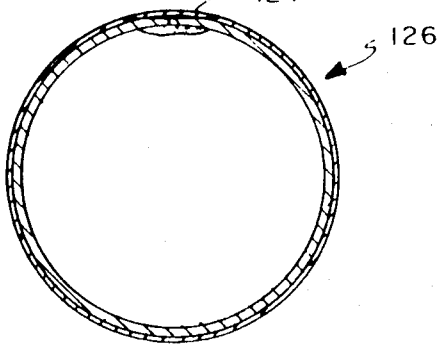

The tubing is advanced from the seam pickling station 20 to a rinsing station 22, where the tubing is rinsed free of the acid and its reaction products and where, preferably, the tubing is dried. Following the rinsing station 22, the tubing passes to a heating station 24 which is located upstream from a galvanizing bath 26 and which heating station preferably utilizes induction heating, although other types of heating can be employed. In order to guard against oxidation of the cleaned tubing, an inert or non-oxidizing atmosphere, for example, nitrogen, is used to surround the tubing from the time at which it enters the heating station 24 until it passes into the zinc bath. The details of preferred embodiments with respect to providing such an atmosphere are set forth in the aforementioned patents. In the heating station, the tubing is preheated to a temperature of between about 800° F. and about 1000° F., and preferably between about 830° F. and 870° F. to cause the zinc coating of the so-heated galvanized tubing to begin to flow. The heated tubing is then passed into the galvanizing bath 26 where the now-flowable, zinc coating of the starting material is contacted with the molten zinc of the galvanizing bath 26, such that a uniform and coherent galvanized coating 124 is formed around the entire exterior surface of the tubing 126. See FIG. 3D. Appropriate wiping is effected at the exit of the zinc bath, and the "regalvanized" tubing proceeds immediately to a cooling station 28, preferably utilizing a water quench, which lowers the temperature of the exterior surface to a level where contact with the take-off device 32 may occur without detriment to the zinc coating. It will be understood by those skilled in the art that the term "galvanizing," as used herein, is employed in its broadest sense and is not intended to be restricted to the employment of pure zinc, inasmuch as it is well known to employ zinc:aluminum alloys.

After cooling to the desired temperature is effected, the tubing next enters a sizing station 30 before entering a straightening station 34. In the upstream region of the production line, there is ample opportunity to support the tubing against sagging as a result of gravity, and of course, the sizing and straightening rolls provide such support as well as drive the tubing longitudinally. Upon exit from the cooling station the tubing immediately moves to the take-off assist device 32 (fully described in the commonly-assigned U.S. Pat. No. 3,965,551), which is located immediately thereafter. An ancillary roller support for the continuously moving tubing could be provided at a location in the water quench station where the temperature of the tubing will have fallen below a suitable level where such contact may occur without detriment to the regalvanized surface. However, inasmuch as this point would be of necessity quite close to the take-off assist device 32, such additional support is considered to be superfluous. A traveling shear 36 is preferably employed to sever the tubing to desired lengths. A tube straightening station 34 might optionally be employed between the cooling system 28 and the shear 36.

The seam-pickling station 20 (shown in FIG. 2) which enables acid treatment of substantially only the scarfed area 122 employs a wick applicator 104 which is suitably shaped and sized to contact substantially only the scarfed area 122 of the tubing. See FIG. 3D. As used herein, the term "wick" or "wick applicator" means an acid-resistant, porous material having high tensile strength, which is capable of transporting liquid by means of capillary action. It will be appreciated that the width of the scarfed area varies directly with the size of the tubing. For example, a scarfed area approximately ¼" wide is typical for 2" diameter tubing. The wick is maintained in frictional contact with the scarfed seam area of the tubing, such that a layer of acid is applied to the scarfed area 122 as it advances relative the wick. Dacron polyester felt is a preferred material for fabricating the wick, due to its acid resistance and high tensile strength. Of course, other porous materials which meet these requirements may be used.

The term "acid" as used herein means an acid, which is capable of reacting with metal oxides (e.g., ferric and ferrous oxides) and facilitating their removal from a metallic surface. It is preferred to employ a concentration of about 10% muriatic acid, although similar concentrations of sulfuric acid or other acids known for pickling metal may be used. It will be understood by the art-skilled that the concentration of acid should be chosen so as to keep the reaction time to a minimum (preferably about 1-5 seconds) to allow the apparatus of the invention to achieve a high rate of production (e.g., 300-400 linear feet per minute), while at the same time said concentration should not be so high as to unnecessarily generate acid fumes.

Figure 2:
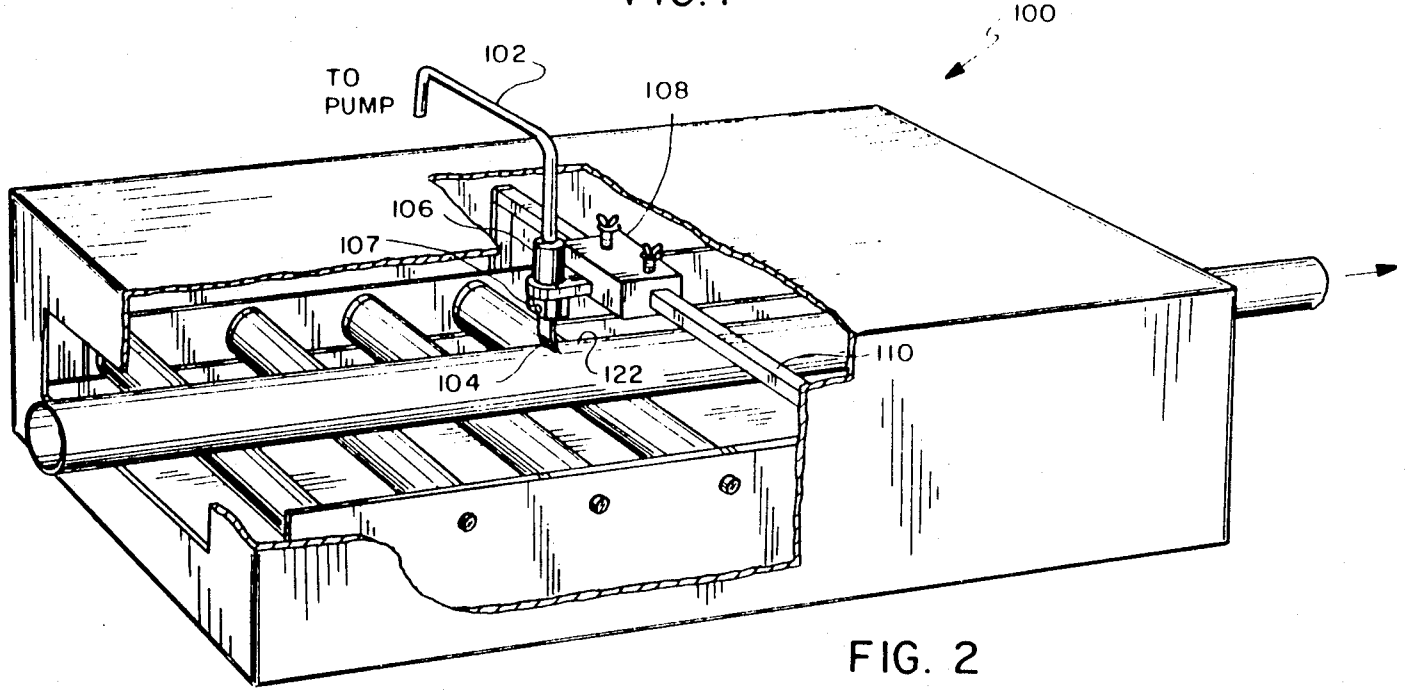
FIG. 2 is a perspective view, with certain components broken away to expose underlying components, of a seam-pickling apparatus of the present invention for applying a quantity of acid to substantially only the scarfed area of continuously advancing tubing.

With reference to FIG. 2, the seam-pickling station for pickling substantially only the scarfed seam area of the continuously advancing tubing will now be described in more detail. The seam-pickling station 100 includes an acid reservoir (not shown) which is suitably sized for holding a sufficient amount of acid to treat a predetermined amount of tubing. The acid reservoir may have a capacity of from about 5-1000 gals or more, and preferably will have a capacity of at least about several hundred gallons to facilitate uninterrupted runs of the tube production mill. An acid line 102 is in communication with the reservoir at one end and with said wick 104 at the other. Conventional means for pumping acid to the wick 104 may be provided, although gravity feed may be used to maintain pressure in line 102 where the reservoir is suitably sized (e.g., 5-50 gals). The wick applicator 104 is inserted inside the acid line so as to facilitate capillary action, while at the same time preventing leakage of acid from the line 102. Although, the wick 104 may merely be forced into line 102 and maintained there by frictional forces, preferably a clamp 106 is employed to immobilize the wick; and, more preferably, clamp 106 may be adapted to include flow regulating means 107, for example, a clamp having means for continuously adjusting its inside diameter for varying the diameter of line 103 in the region where wick 104 is inserted to thereby regulate the flow of acid.

Lateral adjusting means may also be provided for adjusting the position of wick 104 with respect to the longitudinal center line (i.e., the scarfed area) of the advancing tubing such that contact may be maintained between wick 104 and the scarfed area 122, despite inherent lateral drift which may occur between said scarfed area and wick 104. Thus, where the scarfed seam area of the advancing tube faces upward (as is conventional with such production lines) and the advancing tubing drifts slightly to the right or the left, the wick can be correspondingly adjusted to maintain full contact with the scarfed seam area. As shown in FIG. 2, the lateral adjusting means comprises a clamp 108 slideably mounted on a horizontal rail 110 positioned directly above and close to the seam of the advancing tubing and oriented perpendicularly to the longitudinal axis thereof. Clamp 108 is adapted to reversibly bind rail 110 and also to receive wick retaining clamp 106 in order to biasingly maintain wick 104 in frictional contact with the scarfed seam area 122 of the advancing tubing, so that a quantity of acid may be applied to the scarfed area. It will be understood that said quantity of acid must be sufficient to react with substantially all of the metal oxide, but not so great as to overflow the scarfed area.

As a method, the present invention includes the following steps:

1. A galvanized metal strip is formed into tubing as the strip moves along a straight line longitudinal path.
2. Adjacent lateral edges of the moving strip are continuously welded to complete the tubing.
3. Irregularities formed along the welded seam are removed using a scarfing tool.
4. The tubing is cleaned to remove any lubricant associated with roll-forming.
5. A quantity of acid is applied to substantially only the scarfed seam area to react with oxidized metal resulting from the scarfing step.
6. The tubing is rinsed to remove the reaction products and any unreacted acid, and then dried.
7. The tubing is heated to a temperature sufficient to cause the zinc layer of the exterior surface of the galvanized tubing to become flowable.
8. The heated, zinc-coated, exterior surface of the tubing is contacted with additional molten zinc, so as to form a uniform layer of molten zinc around the circumference of the exterior surface including scarfed area.
9. The tubing is cooled to complete the regalvanizing step.

In view of the above, it will be seem that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A seam-pickling station for use in a continuous roll-forming mill tubing production line, which line includes a welding station which joins the edges of a strip by forming a welded seam and a scarfing station for removing irregularities resulting from the welding to produce a scarfed area substantially along the welded seam, said seam pickling station comprising:

an acid reservoir;

a wick applicator suitably sized to contact substantially only said scarfed area;

an acid line for connecting said reservoir to said wick applicator;

pressurizing means for maintaining pressure within said acid line;

biasing means for maintaining said wick applicator in frictional contact with the scarfed seam area of the advancing tubing.

2. A seam-pickling station according to claim 1 further comprising means for laterally adjusting the position of said wick applicator relative to the scarfed seam area of the advancing tubing.

3. A seam-pickling station according to claim 1 further comprising wick retaining means for retaining a part of said wick within the acid line.

4. A seam-pickling station according to claim 3 further comprising means for regulating the flow of acid to the wick.

5. An in-line, continuous, roll-forming tube mill production line comprising:

a supply station for continuously supplying steel strip, said strip galvanized on at least one side, said one side to become the exterior of the tubing;

means for continuously moving said galvanized strip along a straight-line longitudinal path;

a roll-forming station for forming said moving strip into a tubular configuration;

a welding station for joining by welding the edges of said moving strip;

a scarfing station for removing irregularities formed by the welding of the galvanized tubing;

a seam-pickling station having means for applying a quantity of acid selectively to substantially only the scarfed area of the tubing; and means for regalvanizing the exterior surface of the tubing by immersion in molten zinc.

* * * * *

UNITED STATES PATENT AND TRADEMARK OFFICE

CERTIFICATE OF CORRECTION

PATENT NO. : 5,113,557

DATED : May 19, 1992

INVENTOR(S) : Kalyan K. MAITRA et al.

It is certified that error appears in the above-identified patent and that said Letters Patent is hereby corrected as shown below:

ON THE TITLE PAGE:

[57] ABSTRACT, line 4, after "tubing" insert a comma.

[57] ABSTRACT, line 9, after "and" change "the" to --then--.

Column 1, line 6, after "1989" insert a comma.

Column 1, line 16, change "know" to --known--.

Column 3, line 25, change "and" to --end--.

Column 5, line 31, change ".300" to -- ~300 --.

Column 6, line 42, change "seem" to --seen--.

Column 7, line 7, change "claim 1" to --claim 2--.

Signed and Sealed this

Seventeenth Day of August, 1993

Bruce Lehman

*Attest:*

BRUCE LEHMAN

*Attesting Officer*

*Commissioner of Patents and Trademarks*